United States Patent [19]

Noguera

[11] 4,228,564

[45] Oct. 21, 1980

[54] TOP ARMS FOR TEXTILE FIBRE ROLLER

[76] Inventor: John M. Noguera, 1 Greville House, Kinnerton St., London S.W.1, England

[21] Appl. No.: 884,233

[22] Filed: Mar. 7, 1978

[30] Foreign Application Priority Data

May 9, 1977 [GB] United Kingdom ..... 19409/77

[51] Int. Cl.[2] ..... D01H 5/50

[52] U.S. Cl. ..... 19/282

[58] Field of Search ..... 19/266, 267, 279–282, 19/272, 277, 295

[56] References Cited

U.S. PATENT DOCUMENTS

| | | | |
|---|---|---|---|
| 2,801,448 | 8/1957 | Anderson et al. | 19/281 |
| 3,722,036 | 3/1973 | Fuchs | 19/282 |

FOREIGN PATENT DOCUMENTS

| | | | |
|---|---|---|---|
| 1931689 | 1/1971 | Fed. Rep. of Germany | 19/295 |
| 671640 | 5/1952 | United Kingdom | 19/282 |
| 671641 | 5/1952 | United Kingdom | 19/282 |
| 1339168 | 11/1973 | United Kingdom . | |

*Primary Examiner*—Louis Rimrodt

*Attorney, Agent, or Firm*—Blair, Brown & Kreten

[57] ABSTRACT

This invention relates to top arms for textile fibre roller drafting mechanisms, and in particular structure associated with same to permit the exclusive use of low ratio springs to change the pressure on the top rollers between at least two force magnitudes.

7 Claims, 1 Drawing Figure

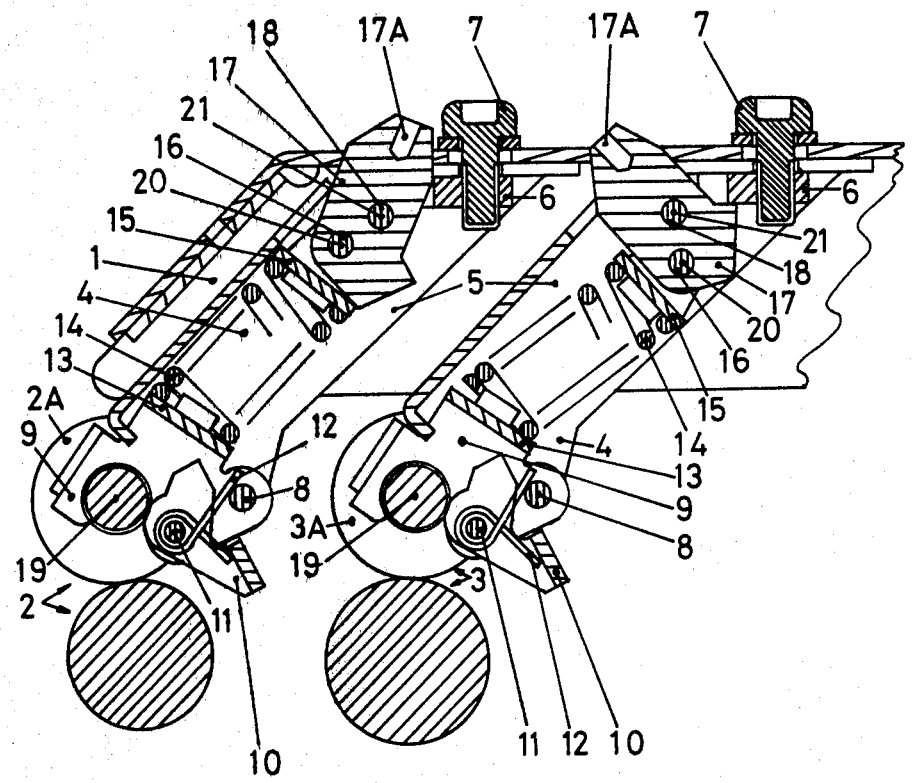
18
17A
7
17A
7
17
21
16
20
15
1
4
14
13
2A
9
19
2
11
10
12
8
3A
19
3
11
12
10
6
5
6
21
18
17
20
16
15
14
4
13
9
8

TOP ARMS FOR TEXTILE FIBRE ROLLER

BACKGROUND OF THE INVENTION

In drafting mechanisms, top arms are employed that extend over the drafting field from a rear mounting and have devices for holding and weighting consecutive dual boss top-rollers from centre necks of the rollers. For any particular fibre each such device should provide a fixed weighting pressure on the dual boss top-roller held thereby, but a different fibre may require a different weighting pressure, particularly where man-made fibres are concerned. The change in weighting required can be high, and desirably it should be possible to double the weighting as between "light weight" and "heavy weight". To obtain such a magnitude of change in devices employing springs to exert the weighting pressure, high ratio springs (i.e. springs which give a big change in pressure for a small change in compression) have been used in conjunction with mechanism operable manually to alter the compression of the springs. However, high ratio springs have the drawback that there is a tendency for the weighting pressure to change during the normal operating up-and-down movements of the top-rollers.

SUMMARY AND OBJECTS OF THE INVENTION

According to the present invention there is provided a top-roller weighting device for use with a textile fibre roller drafting mechanism top arm; the device comprising a body, a top-roller retainer guided by the body, a spring acting so as to apply pressure on the top-roller retainer, and a weight adjuster that moves between at least two rest positions to alter the angle of action of the spring and hence to alter the effective weight applied to the top roller. In such an arrangement, since the pressure of the spring does not have to be altered to achieve a change in the weighting applied to the top-roller the spring utilised can be a low ratio spring.

In a particular form, both the roller retainer and the weight adjuster are pivotally supported by the body of the device, and the spring acts between the roller retainer and a support for the spring, which support is pivotally carried by the weight adjuster. The weight adjuster is movable from a position in which the axis of a top roller held by the device, the pivot axis of said support, and the pivot axis of the adjuster are substantially co-planar with the line of action of the spring so that substantially the full pressure of the spring is applied to the top-roller, to a position in which the pivot axis of said support is significantly clear of the plane containing the axis of the top-roller and the pivot axis of the adjuster and the line of action of the spring is significantly clear of the last mentioned plane whereby only a proportion of the full pressure of the spring (which pressure is in itself substantially unaltered) is transmitted to the top-roller.

For a better understanding of the invention and to show how the same may be carried into effect, reference will now be made, by way of example, to the accompanying drawing.

BRIEF DESCRIPTION OF THE DRAWING

The single FIGURE is a sectional side view of part of a drafting mechanism top arm.

BRIEF DESCRIPTION OF THE PREFERRED EMBODIMENT

In the FIGURE there is shown the free end of the top arm 1 of a drafting mechanism. In the FIGURE the arm is of the usual inverted 'U' section but this is not an essential feature of the invention. The drafting mechanism has roller pairs arranged in three consecutive rows of upper and lower rollers, of which the front rollers 2 and middle rollers 3 are visible in the FIGURE. Each of the top-rollers of these pairs, of which the front and middle top-rollers 2A, 3A are visible in the FIGURE, is held by a weighting device 4 the main body 5 of which is guided within the inverted 'U' section of the arm and secured to it by a screw 7 which fastens into the nut 6.

At the lower end of the device 4 there is pivoted to the body 5, by a pin 8, a top-roller retainer 9 that firmly guides the arbor of the top-roller, the roller upon its insertion into the retainer 9 pushing an eccentric clip 10 around a pivot pin 11 against the action of a spring 12 so that the clip 10 serves to hold the roller in position. Other mechanisms for retaining the top-roller in the device 4 may, however, be provided, and the top-roller retainer may be arranged to slide up and down within the body of the device instead of being pivotted thereto.

The upper part of the retainer 9 is formed as a lower platform support 13 for a coil spring 14, the upper platform support 15 for which is free to swing about a pivot pin 16. This pin 16 is carried by a weight adjuster 17 that itself is pivoted at a pin 18 to the body 5 so that it can be moved into either a "heavy weight" position (in which the adjuster 7 for the front top-roller 2A is shown in the FIGURE), or a "light weight" position (in which the adjuster for the middle top-roller 3A is shown in the FIGURE). Setting of the adjuster 17 is achieved by inserting an adjusting pin (not shown) in a recess 17A in the adjuster 17 accessible from outside the device 4.

A coil type spring is preferred because of the overall dimensional requirements of the device. Other springs, however, in particular 'U' shaped flat springs, could be used.

In an alternative arrangement, not illustrated, the weight adjuster is designed to slide along the top of the body of the device, between at least two rest positions, instead of being pivotally fixed thereto.

In each of the positions of the adjuster 17, the position of the upper platform support 15 relative to the adjuster 17 is determined by the action of the spring 14. It is to be noted that for each position of the adjuster 17 the length of the spring 14 is substantially the same so that the pressure exerted by the spring is substantially the same in each position. However, whereas in the "heavy weight" position the axes 19, 20, 21 respectively of the top-roller, the pin 16 and the pin 18 are substantially co-planar with the line of action of the spring 14 (the axis 20 being slightly to one side of the plane containing the axes 19 and 21 to ensure stable positioning of the spring 14), in the "light weight" position the axis 20 is significantly clear of the plane containing the axes 19 and 21 (on the opposite side thereof as compared with the "heavy weight" position) and the line of action of the spring 14 is inclined to this plane. Thus, in the "heavy weight" position the spring 14 acts almost at right angles to the upper surface of the roller retainer 9 and substantially the full pressure of the spring 14 is transmitted to the top-roller. On the other hand, in the "light weight" position, although the spring pressure is substantially unaltered, as the spring is angled with respect to the retainer upper surface only a proportion of the full pressure of the spring 14 is transmitted to the top-roller.

As the weighting pressure applied to the top-roller held by each device 4 can be selected by adjusting the position of the adjuster 17 of the device without substantially altering the spring pressure, the spring can be a low ratio spring.

Preferably the pressure acting in the "light weight" position is further reduced by designing the various components so that, as shown in the FIGURE, part of the lower end of the spring 14 is clear of the lower platform 13 in the "light weight" position. The arrangement is such that the part of the spring 14 that is nearest to the pivot pin 8 is the part that bears on the lower platform 13 whereby the turning moment applied by the spring to the platform 13 is at a minimum value.

In the roller weighting device described, the weight adjuster is movable between two rest positions hereinbefore referred to as the "heavy weight" position and the "light weight" position. If desired it can be arranged that the adjuster has more than two rest positions so that the weighting pressure applied to the top-roller held by the device can be selected from a range of more than two values.

What we claim is:

1. A top-roller weighting device for use with a textile fibre roller drafting mechanism top arm; the device comprising a body, a top-roller retainer guided by the body, spring means acting so as to apply pressure on the top-roller retainer, and a weight adjuster that moves between at least two rest positions to alter the angle of action of the spring means but not its length to thereby alter the effective weight applied to the top-roller by changing the direction of force of the spring from a substantially linear force to a force having components in two directions and in which the weight adjuster is pivotally connected to the body of the device.

2. Apparatus as claimed in claim 1 in which the top-roller retainer is pivotally connected to the body of the device.

3. Apparatus as claimed in claim 1 in which the spring means comprise a coil spring acting in compression.

4. Apparatus as claimed in claim 1, in which the upper end of the spring means is located on a support which is pivotally attached to the weight adjuster.

5. Apparatus as claimed in claim 1, in which the device is guided within an inverted 'U' shaped roller drafting mechanism top arm and is secured thereto by means of a screw.

6. Apparatus as claimed in claims 1, 2, 3, 4 or 5 in which the roller retainer carries a spring-biassed eccentric for holding the top-roller.

7. The apparatus of claim 1 in which said adjuster is provided with a portion which extends through the body and said adjuster is provided with a recess on a top face thereof which allows the adjuster to be moved to the different rest positions.

* * * * *